US006856955B1

(12) United States Patent
Ozawa

(10) Patent No.: US 6,856,955 B1
(45) Date of Patent: Feb. 15, 2005

(54) VOICE ENCODING/DECODING DEVICE

(75) Inventor: Kazunori Ozawa, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/743,543

(22) PCT Filed: Jul. 9, 1999

(86) PCT No.: PCT/JP99/03722

§ 371 (c)(1),
(2), (4) Date: Jan. 10, 2001

(87) PCT Pub. No.: WO00/03385

PCT Pub. Date: Jan. 20, 2000

(30) Foreign Application Priority Data

Jul. 13, 1998 (JP) ..... 10-197154

(51) Int. Cl.[7] ..... G10L 19/04
(52) U.S. Cl. ..... 704/221; 704/222
(58) Field of Search ..... 704/221, 222, 704/223, 203

(56) References Cited

U.S. PATENT DOCUMENTS

| | | | | | |
|---|---|---|---|---|---|
| 5,659,661 | A | * | 8/1997 | Ozawa | 704/228 |
| 5,682,407 | A | * | 10/1997 | Funaki | 375/240 |
| 5,737,484 | A | * | 4/1998 | Ozawa | 704/219 |
| 5,778,334 | A | * | 7/1998 | Ozawa et al. | 704/219 |
| 5,826,226 | A | * | 10/1998 | Ozawa | 704/223 |
| 5,933,802 | A | * | 8/1999 | Emori | 704/219 |
| 6,272,459 | B1 | * | 8/2001 | Takahashi | 704/221 |

FOREIGN PATENT DOCUMENTS

| | | |
|---|---|---|
| JP | 64-40899 | 2/1989 |
| JP | 4-171500 | 6/1992 |
| JP | 4-363000 | 12/1992 |
| JP | 5-6199 | 1/1993 |
| JP | 5-19796 | 1/1993 |
| JP | 5-165500 | 7/1993 |

(List continued on next page.)

OTHER PUBLICATIONS

"Code–exited linear prediction: High quality speech at very low bit rates" by M. Schroeder and B. Atal (Proc. ICASSP, pp. 937–940, 1985).
"Improved speech quality and efficient vector quantization in SELP" by Klein et al., (Proc. ICASSP, pp. 155–158, 1988).
"16 kbps wideband speech coding technique based on algebraic CELP" (Proc. ICASSP, pp. 13–16, 1991 by C. Laflamme et al.
"Signal Analysis and System Identification" by Nakamizo (pp. 82–87, issued in 1988, Corona Publishing Co., Ltd.
"Speech information compression by *linear spectrum pair* (*LSP*) voice analysis synthesis method" (Journal of the Institute of Electronics, Information and Communication Engineers, J64–A, pp. 599–606, 1981.
"LSP Coding Using VQ–SVQ With Interpolation in 4.075 kbps M–LCELP speech coder" by T. Nomura et al., (Proc. Mobile Multimedia Communications, PP B. 2. 5, 1993).
"Pitch predictors with high temporal resolution" by P. Kroon et al., (Proc. ICASSP, pp. 661–664, 1990).

*Primary Examiner*—Daniel Abebe
(74) *Attorney, Agent, or Firm*—Dickstein, Shapiro, Morin & Oshinsky, LLP.

(57) ABSTRACT

A voice coding apparatus which can obtain preferable sound quality at a low bit rate is provided. In a mode decision circuit 800 of the voice coding apparatus, a mode is decided from an input voice signal by using a characteristic amount every sub-frame. In a sound source quantization circuit 350, in case of a predetermined mode, the amplitude or polarity of a non-zero pulse is calculated in advance. Further, combinations of a plurality of shift amounts by which the position of a predetermined pulse is time-shifted and a gain code vector for quantizing a gain are searched. Finally, the combination which minimizes distortion between a reproduced voice and an input voice is selected.

5 Claims, 11 Drawing Sheets

FOREIGN PATENT DOCUMENTS

| | | |
|---|---|---|
| JP | 6-222797 | 8/1994 |
| JP | 9-44195 | 2/1997 |
| JP | 9-120298 | 5/1997 |
| JP | 10-11093 | 1/1998 |
| JP | 10-20894 | 1/1998 |
| JP | 10-55198 | 2/1998 |

* cited by examiner

FIG. 2

$$D = \sum_{i=1}^{10} W(i)[LSP(i) - QLSP(i)_i]^2 \quad (1)$$

FIG. 3

$$x_z(n) = d(n) - \sum_{i=1}^{10} \alpha_i d(n-i) + \sum_{i=1}^{10} \alpha_i \gamma^i y(n-i) + \sum_{i=1}^{10} \alpha_i \gamma^i x_z(n-i) \quad (2)$$

where, when $n - i \leq 0$ $$y(n-i) = p(N + (n-i)) \quad (3)$$

$$x_z(n-i) = s_w(N + (n-i)) \quad (4)$$

FIG. 4

$$x_w(n) = x_w(n) - x_z(n) \quad (5)$$

FIG. 5

$$H_w(z) = \frac{1 - \sum_{i=1}^{10} \alpha_i z^{-i}}{1 - \sum_{i=1}^{10} \alpha_i \gamma^i z^{-i}} \cdot \frac{1}{1 - \sum_{i=1}^{10} \alpha_i \gamma^i z^{-i}} \tag{6}$$

FIG. 6

$$D_r = \sum_{n=0}^{N-1} x_w'^2(n) - [\sum_{n=0}^{N-1} x_w'(n) y_w(n-T)]^2 / [\sum_{n=0}^{N-1} y_w^2(n-T)] \tag{7}$$

where $$y_w(n-T) = v(n-T) * h_w(n) \tag{8}$$

FIG. 7

$$\beta = \sum_{n=0}^{N-1} x_w'(n) y_w(n-T) / \sum_{n=0}^{N-1} y_w^2(n-T) \tag{9}$$

FIG. 8

$$e_w(n) = x_w(n) - \beta v(n-T) * h_w(n) \tag{10}$$

FIG. 9

$$D_k = \sum_{n=0}^{N-1} [e_w(n) - \sum_{i=1}^{M} g_{ik} h_w(n - m_i)]^2 \tag{11}$$

FIG. 10

$$D_{(ki)} = [\sum_{n=0}^{N-1} e_w(n) s_{wk}(m_i)]^2 / \sum_{n=0}^{N-1} s_{wk}^2(m_i) \tag{12}$$

FIG. 11

$$D_{(ki)} = [\sum_{n=0}^{N-1} \Phi(n) v_k(n)]^2 / \sum_{n=0}^{N-1} s_{wk}^2(m) \tag{13}$$

where $$\Phi(n) = \sum_{i=n}^{N-1} e_w(i) h_w(i-n), n = 0, \ldots, N-1 \tag{14}$$

FIG. 12

| PULSE NUMBER | POSITION |
|---|---|
| FIRST PULSE | 0, 5, 10, 15, 20, 25, 30, 35 |
| SECOND PULSE | 1, 6, 11, 16, 21, 26, 31, 36 |
| THIRD PULSE | 2, 7, 12, 17, 22, 27, 32, 37 |
| FOURTH PULSE | 3, 8, 13, 18, 23, 28, 33, 38 |
| FIFTH PULSE | 4, 9, 14, 19, 24, 29, 34, 39 |

FIG. 13

| SHIFT AMOUNT | POSITION |
|---|---|
| 0 | 0, 4, 8, 12, 16, 20, 24, 28, 32, 36 |
| 1 | 1, 5, 9, 13, 17, 21, 25, 29, 33, 37 |
| 2 | 2, 6, 10, 14, 18, 22, 26, 30, 34, 38 |
| 3 | 3, 7, 11, 15, 19, 23, 27, 31, 35, 39 |

FIG. 14

$$D_k = \sum_{n=0}^{N-1} [x_w(n) - \beta'_i v(n-T) * h_w(n) - G'_i \sum_{i=1}^{M} g'_{ik} h_w(n-m_i)]^2 \quad (15)$$

FIG. 15

$$D_k = \sum_{n=0}^{N-1} [x_w(n) - \beta'_i v(n-T) * h_w(n) - G'_i \sum_{i=1}^{M} g'_{ik} h_w(n-m_i - \delta(j))]^2 \quad (16)$$

FIG. 16

$$v(n) = \beta'_i v(n-T) + G'_i \sum_{i=1}^{M} g'_{ik} \delta(n-m_i) \quad (17)$$

FIG. 17

$$v(n) = \beta'_i v(n-T) + G'_i \sum_{i=1}^{M} g'_{ik} \delta(n-m_i - \delta(j)) \quad (18)$$

FIG. 18

$$s_w(n) = v(n) - \sum_{i=1}^{10} \alpha_i v(n-i) + \sum_{i=1}^{10} \alpha_i \gamma^i p(n-i) + \sum_{i=1}^{10} \alpha_i \gamma^i s_w(n-i) \qquad (19)$$

FIG. 20

$$D_{k,j} = \sum_{n=0}^{N-1} [x_w(n) - \beta_i'(n-T) * h_w(n) - G'_i \sum_{i=1}^{M} g'_{ik} h_w(n - m_i - \delta(j))]^2 \qquad (20)$$

VOICE ENCODING/DECODING DEVICE

TECHNICAL FIELD

The present invention relates to a voice coding/decoding apparatus for coding a voice signal at a low bit rate with high quality.

BACKGROUND ART

As a method of efficiently coding a voice signal, for example, a CELP (Code exited linear predictive coding) described in "Code-exited linear prediction: High quality speech at very low bit rates" by M. Schroeder and B. Atal (Proc. ICASSP, pp. 937–940, 1985) (Reference 1) is known. Further, "Improved speech quality and efficient vector quantization in SELP" by Klein et al., (Proc. ICASSP, pp. 155–158, 1988) (Reference 2) is known. In these prior arts, on a transmission side, a spectrum parameter representing the spectrum characteristics of a voice signal is extracted from a voice signal every frame (for example, 20 mS) by using linear prediction (LPC) analysis. The frame is further divided into sub-frames (for example, 5 mS). Parameters (a delay parameter corresponding to a pitch period and a gain parameter) in an adaptive code book every sub-frame on the basis of a past sound source signal, and pitch prediction of the voice signal of the sub-frame is performed by using the adaptive code book. For the sound source signal obtained by the pitch prediction, an appropriate sound source code vector is selected from a sound source code book (vector quantization code book) consisting of noise signals of predetermined types to calculate an appropriate gain, thereby quantizing a sound source signal. The selection of the sound source code vector is performed such that an error power between a signal synthesized by a selected noise signal and the residual signal is minimized. An index representing the type of the selected code vector, a gain, the spectrum parameter, and the parameter of the adaptive code book are combined to each other by a multiplexer unit to be transmitted.

However, in the prior arts described above, an enormous amount of operation is required to select an appropriate sound source code vector from the sound source code book. This is because, in the methods of References 1 and 2, a filtering operation or a convolution operation is temporarily performed to code vectors to select a sound source code vector, and the operation is repeated as many times as is equal to the number of code vectors stored in the code book. By way of example, it is assumed that the number of bits of the code book is B and that the number of dimensions of the code book is N. In this case, when a filter or impulse response length when the filtering operation or the convolution operation is represented by. K, as an amount of operation, $(N \cdot K \cdot 2 \cdot B \cdot 8000)/N$ is required per second. For example, when B=10, N=40, and K=10, the operation must be repeated 81,920,000 times per second. As a result, the remarkably enormous amount of operation is disadvantageously required.

As a method of reducing an amount of operation required to searching a sound source code book, for example, ACELP (Algebraic Code Exited Linear Prediction) is proposed. For this method, for example, "16 kbps wideband speech coding technique based on algebraic CELP" (Proc. ICASSP, pp. 13–16, 1991 by C. Laflamme et al., (Reference 3) can be referred to. According to the method of Reference 3, a sound source signal is represented by a plurality of pulses, and the positions of the pulses are represented by the predetermined numbers of bits and transmitted. Here, since the amplitude of each pulse is limited to +1.0 or −1.0, the amount of operation for searching for the pulse can be considerably reduced. In Reference 3, the amount of operation can be considerably reduced.

However, although preferable sound quality can be obtained at a bit rate of 8 kB/S or more, when a bit rate lower than the value, and when background noise is superposed on voice, the number of pulses is not sufficient, and the sound quality of a background noise component of coded voice is considerably degraded. More specifically, since the sound source signal is represented by a combination of a plurality of pulses, the pulses are concentrated around a pitch pulse which is a start point of the pitches in a vowel range of the voice. For this reason, the sound source signal can be efficiently represented by a small number of pulses. However, since pulses must be raised at random for a random signal such as background noise, it is difficult that the background noise can be preferably represented by a small number of pulses. When the bit rate is reduced to reduce the number of pulses, sound quality for the background noise sharply degraded.

It is, therefore, an object of the present invention to perform voice coding with a relatively small amount of operation, in particular, small degradation of sound quality for background noise even though a low bit rate is set.

DISCLOSURE OF INVENTION

A voice coding apparatus of the present invention includes a vector quantization circuit for calculating a spectrum parameter of a voice signal to quantize the spectrum parameter, an adaptive code book circuit for predicting a voice signal from a sound source signal to calculate a residual, a sound source quantization circuit for quantizing the sound source signal by using the spectrum parameter to output the quantized sound source signal, a gain quantization circuit for quantizing a gain of the sound source signal, a mode decision circuit for extracting characteristics from the voice signal to decide a mode, and a multiplexer unit for multiplexing an output from the spectrum parameter quantization circuit, an output from the mode decision circuit, an output from the adaptive code book circuit, an output from the sound source quantization circuit, and an output from the gain quantization circuit to output the multiplexed result, wherein, when the output from the decision unit represents a predetermined mode, the sound source signal is represented by a combination of a plurality of pulses, the amplitude or polarity of the pulse is calculated from the voice signal, and the sound source quantization unit selects a shift amount and a gain code vector, which minimize distortion between an input signal and a reproduced signal, from combinations of a plurality of shift amounts by which the pulses shift and gain code vectors.

The voice decoding apparatus of the present invention also includes a demultiplexer unit for receiving information related to a spectrum parameter, information related to a decision signal, information related to an adaptive code book, and information related to a sound source signal to separate the pieces of information from each other, a sound source signal generation unit for, when the decision signal represents a predetermined mode, generating a sound source signal from an adaptive code vector, a shift amount of a pulse position, and a gain code vector, and a synthesis filter unit for receiving the sound source signal constituted by a spectrum parameter to output a reproduced signal. In this case, when the decision signal represents a specific mode, pulse positions may be generated at random, and a sound source signal is generated by using the adaptive code vector and the gain code vector.

BRIEF DESCRIPTION OF DRAWINGS

FIG. 2 is an equation expressing distortion generated when linear spectrum pair (LSP) parameter quantization is performed.

FIG. 3 is an equation expressing a response signal $x_z$ when an input signal is set to be zero (d(n)=0).

FIG. 4 is an equation for calculating a response signal from a perceptual weighting signal.

FIG. 5 is an equation expressing an impulse response of a perceptual weighting filter.

FIG. 6 is an equation for minimizing a delay T corresponding to a pitch.

FIG. 7 is an equation expressing a gain β.

FIG. 8 is an equation for performing pitch prediction.

FIG. 9 is an equation for selecting a combination of a code vector and a position.

FIG. 10 is an equation for minimizing the equation shown in FIG. 9.

FIG. 11 is another equation for minimizing the equation shown in FIG. 9.

FIG. 12 is a table in which a sound source signal is transmitted such that the positions of a plurality of pulses are represented by predetermined numbers of bits.

FIG. 13 is a table for a specific mode in which a sound source signal is transmitted such that the positions of a plurality of pulses are represented by predetermined numbers of bits.

FIG. 14 is an equation showing a polarity for the shift amounts and the pulse positions shown in FIG. 13.

FIG. 15 is an equation for selecting a gain code vector and a shift amount.

FIG. 16 is an equation for calculating a drive sound source signal.

FIG. 17 is another equation for calculating a drive sound source signal.

FIG. 18 is an equation expressing a response signal.

FIG. 20 is an equation for selecting a pulse position and a gain code vector.

BEST MODE FOR CARRYING OUT THE INVENTION

The best mode for carrying out the present invention will be described below with reference to the drawings.

(First Embodiment)

Figure 1:
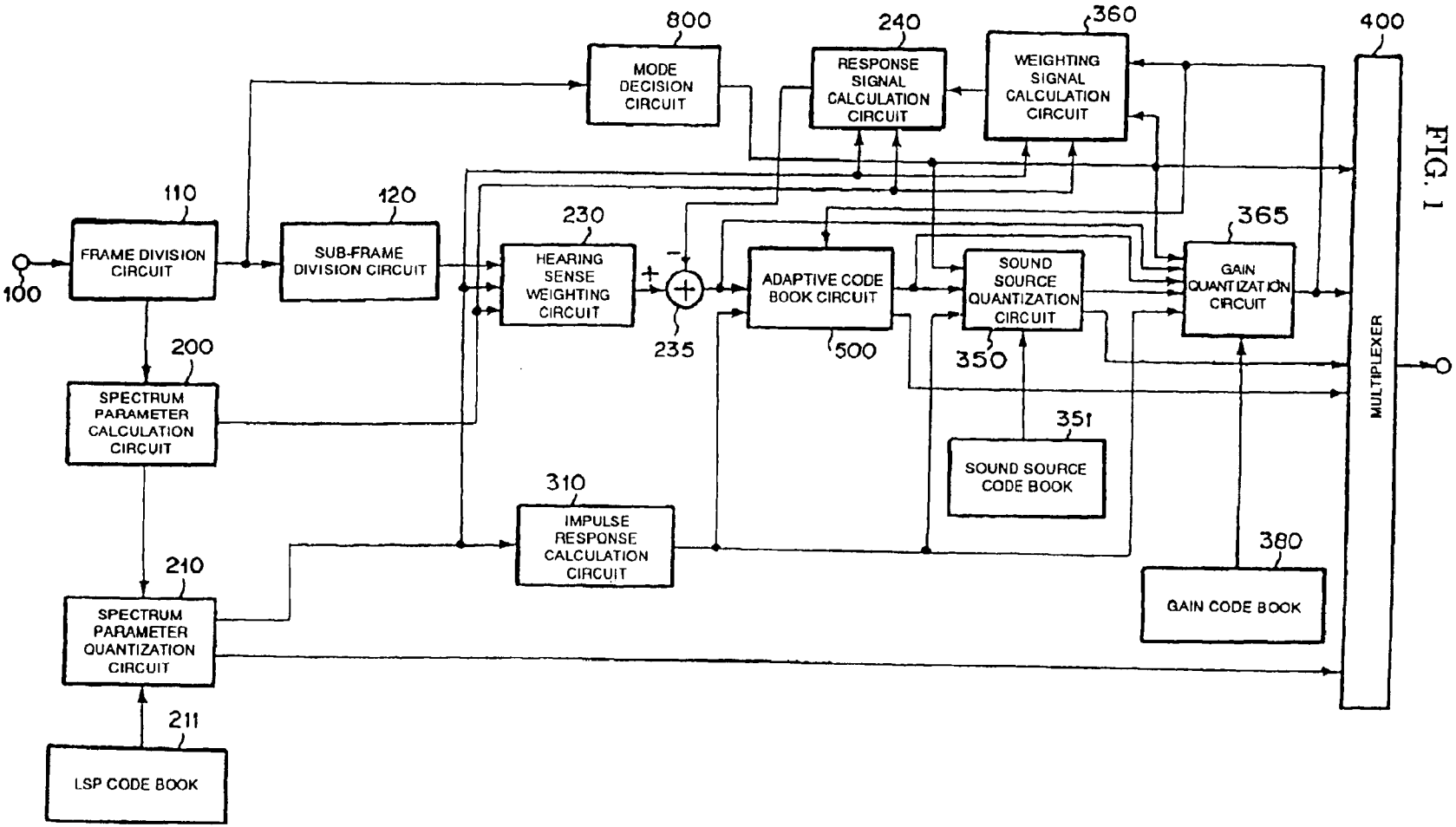
FIG. 1 is a block diagram of a voice coding apparatus according to the present invention.

FIG. 1 is a block diagram of a voice coding apparatus according to the present invention. In FIG. 1, a voice signal is input from an input terminal 100, and the voice signal is divided by a frame division circuit 110 every frame (for example, 20 mS). In a sub-frame division circuit 120, the voice signal of the frame is divided into sub-frames each of which is shorter than the frame (for example, 5 mS).

In a spectrum parameter calculation circuit 200, a windows which is longer than a sub-frame length (for example, 24 mS) is applied to the voice signal of at least one sub-frame to cut a voice, and the spectrum parameter is raised to the power of a predetermined number (for example, P=10th). In the calculation of the spectrum parameter, the known LPC analysis, a BURG analysis, and the like can be used. In this case, it is assumed that the BURG analysis is used. The details of the Burg analysis are described in "Signal Analysis and System Identification" by Nakamizo (pp. 82 to 87, issued in 1988, Corona Publishing Co., Ltd.) (Reference 4) or the like.

In addition, in a spectrum parameter calculation unit, a linear prediction coefficient αil (i=1, . . . , 10) calculated by the Burg method is converted into an LSP parameter which is appropriate to quantization or interpolation. Here, with respect to the conversion from the linear prediction coefficient into the LSP, "Speech information compression by linear spectrum pair (LSP) voice analysis synthesis method" (Journal of The Institute of Electronics, Information and Communication Engineers, J64-A, pp. 599–606, 1981) (Reference 5) can be referred to. For example, linear prediction coefficients calculated by the BURG method in the second and fourth sub-frames are converted into LSP parameters, and the LSPs of the first and third sub-frames are calculated by linear interpolation. The LSPs of the first and third sub-frames are subjected to inverse conversion to be returned to linear prediction coefficients, and linear prediction coefficients αil (i=1, . . . , 10, 1=1, . . . , 5) of the first to fourth sub-frames are output to a perceptual weighting circuit 230. The LSP of the fourth sub-frame is output to a spectrum parameter quantization circuit 210.

In the spectrum parameter quantization circuit 210, the LSP parameter of a predetermined sub-frame is efficiently quantized, and a quantization value for minimizing distortion expressed by Equation (1) shown in FIG. 2.

In this case, LSP (i), QLSP (i) J, and W (i) are an i-th LSP before quantization, a j-th result after quantization, and a weighting coefficient, respectively.

In the following description, it is assumed that vector quantization is used as a quantization method and that the LSP parameter of the fourth sub-frame is quantized. As the vector quantization method of an LSP parameter, a known method can be used. As a concrete method, Japanese Patent Application Laid-Open No. 4-171500 (Reference 6), Japanese Patent Application Laid-Open No. 4-363000 (Reference 7), A Japanese Patent Application Laid-Open No. 5-6199 (Reference 8), or "LSP Coding Using VQ-SVQ With Interolation in 4.075 kbps M-LCELP speech coder" by T. Nomura et al., (Proc. Mobile Multimedia Communications, PP. B. 2. 5, 1993) (Reference 9) can be referred to.

In the spectrum parameter quantization circuit 210, on the basis of the LSP parameter quantized in the fourth sub-frame, the LSP parameters in the first to fourth sub-frames are restored. Here, the quantized LSP parameter of the fourth sub-frame of a current frame and the quantized LSP parameter of the fourth sub-frame of the frame previous to the current frame are linearly interpolated to restore the LSPs of the first to third sub-frames. In this case, after one type of code vector for minimizing an error power between an LSP before quantization and an LSP after quantization is selected, the LSPs of the first to fourth sub-frames can be restored by linear interpolation. In order to further improve the performance, after a plurality of code vectors for minimizing the error power are selected as candidates, and accumulated distortion is evaluated with respect to the candidates, so that a combination of a candidate and an interpolated LSP which minimize the accumulated distortion can be selected.

The LSPs of the first to third sub-frames restored as described above and the quantized LSP of the fourth sub-frame are converted into linear prediction coefficients αil (i=1, . . . , 10, 1=1, . . . , 5) in units of sub-frames, and the linear prediction coefficients αil are output to an impulse response calculation circuit 310. An index representing the code vector of the quantized LSP of the fourth sub-frame is output to a multiplexer 400.

The perceptual weighting circuit 230 receives linear prediction coefficients αil (i=1, . . . , 10, 1=1, . . . , 5) before quantization from the spectrum parameter calculation circuit 200 in units of sub-frames, performs perceptual weighting to the voice signals of the sub-frames on the basis of Reference 1, and outputs perceptual weighting signals.

The response signal calculation circuit 240 receives the linear prediction coefficients αil from the spectrum parameter calculation circuit 200 in units of sub-frames, and receives the linear prediction coefficients αil restored by quantization and interpolation from the spectrum parameter quantization circuit 210 in units of sub-frames. A response signal obtained when an input signal is given by zero d (n)=0 is calculated for one sub-frame by using a stored value of a filter memory, and the response signal is output to a subtractor 235. In this case, a response signal $x_z$ (n) is given by Equation (2), Equation (3), and Equation (4) shown in FIG. 3.

Here, "N" represents a sub-frame length. A reference symbol γ represents a weighting coefficient for controlling an amount of perceptual weighting, and is equal to a value obtained by Equation (7) shown in FIG. 6 to be described later. Reference symbols s w (n) and p (n) represent an output signal from a weighting signal calculation circuit and an output signal of the denominator of a filter of a first term of the right-hand side in Equation (7) to be described later, respectively.

The subtractor 235 subtracts a response signal from the perceptual weighting signal for one sub-frame according to Equation (5) shown in FIG. 4, and x'w (n) is output to an adaptive code book circuit 300.

The impulse response calculation circuit 310 calculates an impulse response Hw (n) of a perceptual weighting filter in which Z conversion is expressed by Equation (6) shown in FIG. 5 with respect to a predetermined number of points L. Resultant values are output to an adaptive code book circuit 500 and a sound source quantization circuit 350.

A mode decision circuit 800 extracts a characteristic amount by using an output signal from a frame division circuit, and decides modes in units of frames. Here, as characteristics, a pitch prediction gain can be used. Pitch prediction gains calculated in units of sub-frames are averaged in an entire frame, and the value is compared with a plurality of predetermined threshold values, so that a plurality of predetermined modes are classified. Here, for example, the number of types of modes is set to be 4. In this case, it is assumed that Modes, 0, 1, 2, and 3 almost correspond to a silent section, a transition section, a weakly voiced section, and a strongly voiced section, respectively. Mode decision information is output to the sound source quantization circuit 350, a gain quantization circuit 365, and the multiplexer 400.

In the adaptive code book circuit 500, a past sound source signal v (n), an output signal x'w (n), and a perceptual weighting impulse response Hw (n) are input from the gain quantization circuit 365, the subtractor 235, and the impulse response calculation circuit 310, respectively. A delay T corresponding to a pitch is calculated such that distortion expressed by Equation (7) shown in FIG. 6 is minimized, and an index representing the delay is output to the multiplexer 400.

In Equation (8), a reference symbol * represents a convolution operation.

A gain β is calculated according to Equation (9) shown in FIG. 7.

In this case, in order to improve the accuracy of delay extraction for female voice or child voice, the delay may be calculated as not only an integer sample, but also a decimal sample value. As a concrete method, for example, "Pitch predictors with high temporal resolution" by P. Kroon et al., (Proc. ICASSP, pp. 661–664, 1990) (Reference 10) can be referred to. In addition, in the adaptive code book circuit 500, pitch prediction is performed according to Equation (10) shown in FIG. 8, and a prediction residual signal $e_w$ (n) is output to the sound source quantization circuit 350.

The sound source quantization circuit 350 receives a mode decision information and switches a quantization method for a sound source signal depending on a mode.

In Modes 1, 2, and 3, it is assumed that M pulses are set. In Modes 1, 2, and 3, it is assumed that a B-bit amplitude code book or a polarity code book for quantizing the amplitudes of the M pulses at once is held. A case in which the polarity code book is used will be described below. The polarity code book is stored in a sound source code book 351.

In a voiced state, the sound source quantization circuit 350 reads polarity code vectors stored in the sound source code book 351, allocates positions to the code vectors, and selects a plurality of combinations of code vectors and positions which minimize Equation (11) shown in FIG. 9.

In this equation, a reference symbol Hw (n) represents a perceptual weighting impulse response.

In order to minimize Equation (11) shown in FIG. 9, a combination of a polarity code vector gik and a position mi which minimize Equation (12) shown in FIG. 10 may be calculated.

The combination of the polarity of code vector gik and the position mi may be selected such that Equation (13) shown in FIG. 11 is maximized. This combination further reduces an operation amount required to calculate the numerator.

In this case, positions at the pulses can be set in Modes 1 to 3 can be restrained as shown in Reference 3. For example, when N=40 and M=5, positions at the pulses can be set are as shown in Table 1 shown in FIG. 12.

Upon completion of searching of polarity code vectors, the plurality of combinations of polarity code vectors and positions are output to the gain quantization circuit 365.

In a predetermined mode (Mode 0 in this example), as shown in Table 2 in FIG. 13, the positions of the pulses are determined at predetermined intervals, and a plurality of shift amounts for shifting the positions of all the pulses are determined in advance. In the following case, four types of shift amounts (Shift 0, Shift 1, Shift 2, and Shift 3) are used such that the positions are shifted by one sample. In this case, the shift amounts are quantized by two bits to be transmitted. In Table 2, shift mount 0 represents the position of a basic pulse. Shift amounts 1, 2, and 3 are obtained by shifting the basic pulse position by one sample, two samples, and three samples, respectively. These four types of shift amounts can be used in this embodiment. However, the types of shift amounts and the number of shift samples can be arbitrarily set.

Polarities to the shift amounts and the pulse positions of Table 2 shown in FIG. 13 are calculated by Equation (14) shown in FIG. 11 in advance.

The positions shown in Table 2 in FIG. 13 and the polarities corresponding thereto are output to the gain, quantization circuit 365 in units of shift amounts.

The gain quantization circuit 365 receives mode decision information from the mode decision circuit 800. From the sound source quantization circuit 350, a plurality of combinations of polarity code vectors and pulse positions are input in Modes 1 to 3, and combinations of pulse positions and polarities corresponding thereto are input in units of shift amounts in Mode 0.

The gain quantization circuit 365 reads a gain code vector from a gain code book 380. In Modes 1 to 3, the gain quantization circuit 365 searches the selected plurality of combinations of polarity code vectors and position for a gain code vector such that Equation (15) shown in FIG. 14 is minimized. A gain code vector for minimizing distortion and one type of combination of a polarity code vector and a position are selected.

Here, a case in which both the gain of an adaptive code book and the gain of a sound source represented by pulses are simultaneously vector-quantized is exemplified. An index representing the selected polarity code vector, a code representing a position, and an index representing a gain code vector are output to the multiplexer 400.

When the decision information is Mode 0, a plurality of shift amounts and polarities corresponding to the positions in the respective shift amounts are input to search for a gain code vector, and a gain code vector and one type of shift amount are selected such that Equation (16) shown in FIG. 15 is minimized.

Here, reference symbols βk and G'k represents the Kth code vector in a two-dimensional gain code book stored in the gain code book 380. Reference symbol δ(j) represents the j-th shift amount, and the reference symbol g'k represents the selected gain code vector. An index representing the selected code vector and a code representing a shift amount are output to the multiplexer 400.

In Modes 1–3, a code book for quantizing the amplitudes of a plurality of pulses can be trained in advance by using a voice signal to be stored. As the method of learning a code book, for example, "An Algorithm for vector quantization design" by Linde rt al., (IEEE Trans. Commun., pp. 84–95, January, 1980) (Reference 11) can be referred to.

The weighting signal calculation circuit 360 receives mode decision information and indexes, and reads code vectors corresponding the indexes from the indexes. In Modes 1 to 3, a drive sound source signal V (N) is calculated on the basis of Equation (17) shown in FIG. 16.

The signal v (n) is output to the adaptive code book circuit 500.

In Mode 0, a drive sound source signal v (n) is calculated on the basis of Equation (18) shown in FIG. 17.

The signal v (n) is output to the adaptive code book circuit 500.

Response signals $s_w$ (n) are calculated for sub-frames by Equation (19) shown in FIG. 18 by using an output parameter from the spectrum parameter calculation circuit 200 and an output parameter from the spectrum parameter quantization circuit 210, and are output to the response signal calculation circuit 240.

(Second Embodiment)

Figure 19:
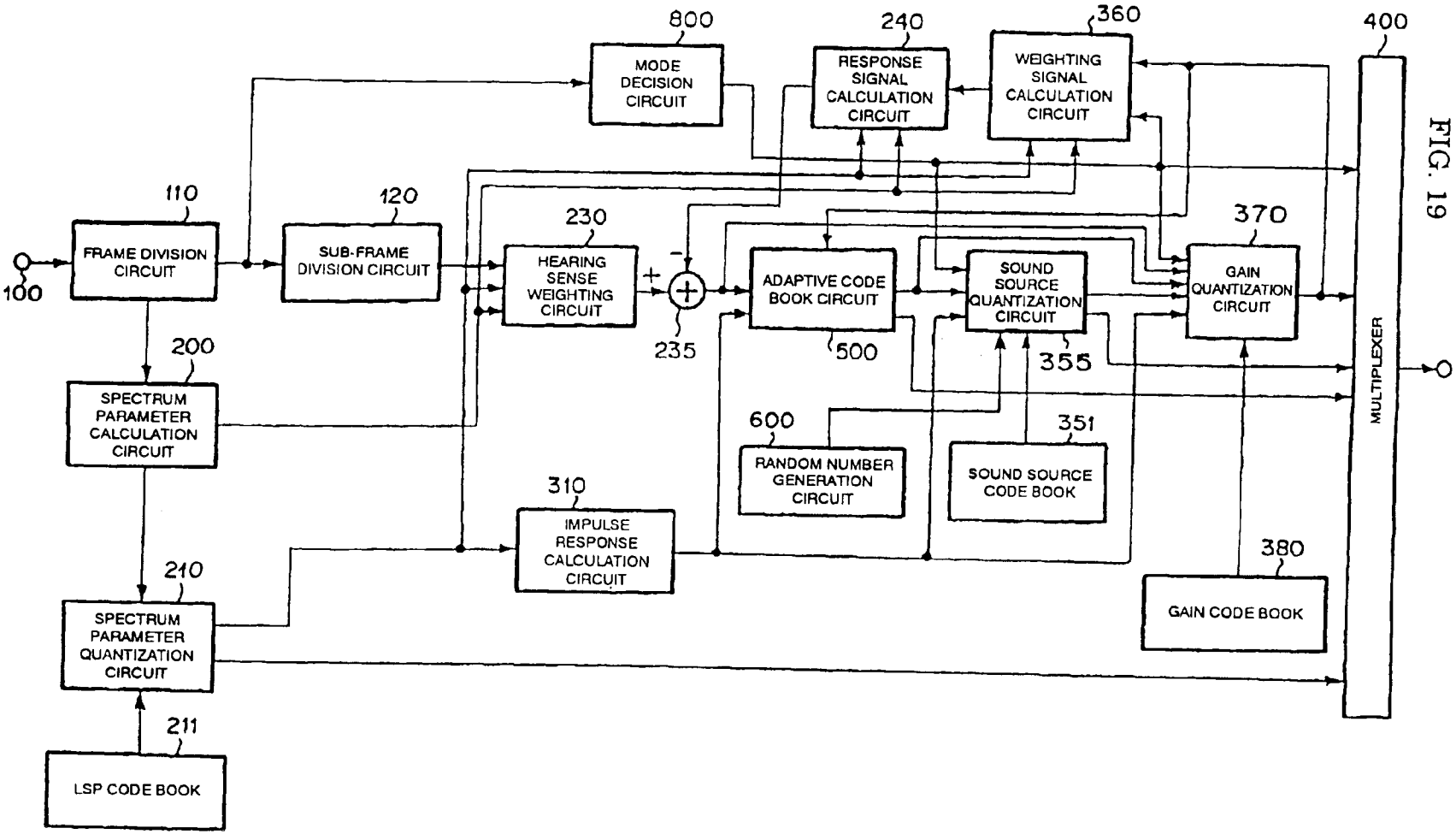
FIG. 19 is a block diagram of another coding apparatus according to the present invention.

FIG. 19 is a block diagram of another coding apparatus according to the present invention. Since constituent elements in FIG. 19 to which the same reference numerals as in FIG. 1 are added perform the same operations as in FIG. 1, a description thereof will be omitted. In FIG. 19, the operation of a sound source quantization circuit 355 is different from that of FIG. 1. In this case, when mode decision information is Mode 0, a position generated according to a predetermined rule is used as a position of a pulse.

For example, the positions of pulses the number of which are predetermined (for example, M1) are generated by a random number generation circuit 600. More specifically, M1 numeral values generated by the random number generator are considered as the positions of pulses. In addition, the plural sets of positions of different types are generated. The M1 positions of the plural sets generated as described above are output to the sound source quantization circuit 355.

When the mode decision information is Modes 1 to 3, the sound source quantization circuit 355 performs the same operation as that of the sound source quantization circuit 350 shown in FIG. 1. In Mode 0, polarities are calculated from Equation (14) in advance for the plural sets of positions output from the random number generation circuit 600.

The plural sets of positions and the polarities corresponding to pulse positions are output to a gain quantization circuit 370.

The gain quantization circuit 370 receives the plural sets of positions and the polarities corresponding to the pulse positions, searches for a combination of gain code vectors stored in the gain code book 380, and selects one type of combination of a set of positions and a set of gain code vectors which minimize Equation (20) shown in FIG. 20 to output the combination.

(Third Embodiment)

Figure 21:
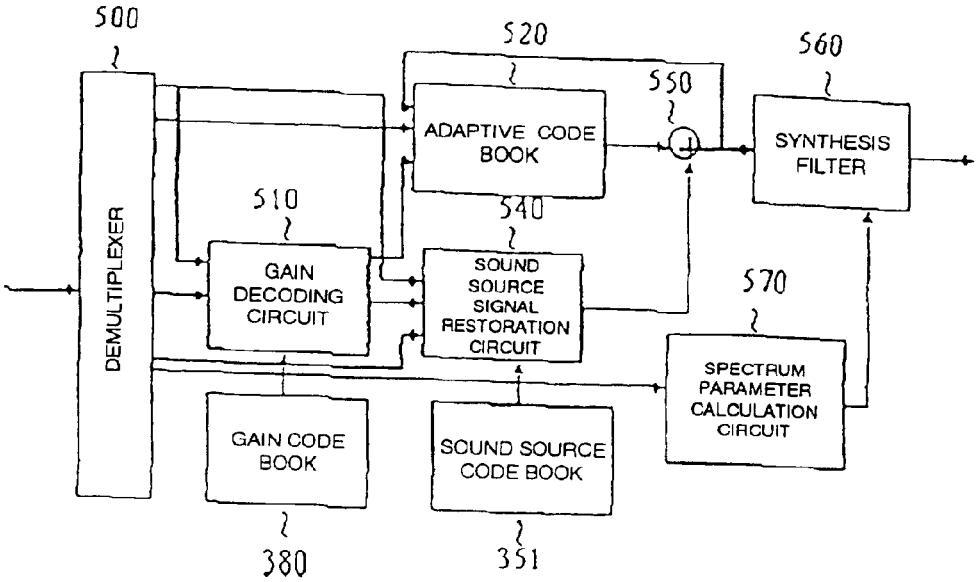
FIG. 21 is a block diagram of a decoding apparatus according to the present invention.

FIG. 21 is a block diagram of a decoding apparatus according to the present invention. This decoding apparatus may be combined to the coding apparatus shown in FIG. 1 to form a coding/decoding apparatus. In FIG. 21, a demultiplexer 500 receives mode decision information, an index representing a gain code vector, an index representing delay of an adaptive code book, information of a sound source signal, an index of a sound source code vector, and an index of a spectrum parameter from a received signal, and separately outputs the respective parameters.

A gain decoding circuit 510 receives the index of the gain code vector and the mode decision information, and reads and outputs a gain code vector from the gain code book 380 depending on the index.

An adaptive code book circuit 520 receives the mode decision information and the delay of the adaptive code book, generates an adaptive code vector, and multiples the gain code vector by the gain of the adaptive code book to output the resultant value.

In a sound source signal restoration circuit 540, when the mode decision information is Modes 1 to 3, a sound source signal is generated by using a polarity code vector read from a sound source code book 351, positional information of pulses, and the gain code vector to output the sound source signal to an adder 550.

When the mode decision information is Mode 0, the sound source signal restoration circuit 540 generates a sound source signal from a pulse position, a shift amount of the position, and the gain code vector to output the sound source signal to the adder 550.

The adder 550 generates a drive sound source signal V (N) by using an output from the adaptive code book circuit 520 and an output from the sound source signal restoration circuit 540 on the basis of Equation (17) in Modes 1 to 3 or on the basis of Equation (18) in Mode 0 to output the drive sound source signal v (n) to the adaptive code book circuit 520 and a synthesis filter circuit 560.

A spectrum parameter decoding circuit 570 decodes a spectrum parameter to convert the spectrum parameter into a linear prediction coefficient, and outputs the linear prediction coefficient to the synthesis filter circuit 560.

The synthesis filter circuit 560 receives the drive sound source signal v (n) and the linear prediction coefficient, calculates a reproduced signal, and outputs the reproduced signal from a terminal 580.

(Fourth Embodiment)

Figure 22:
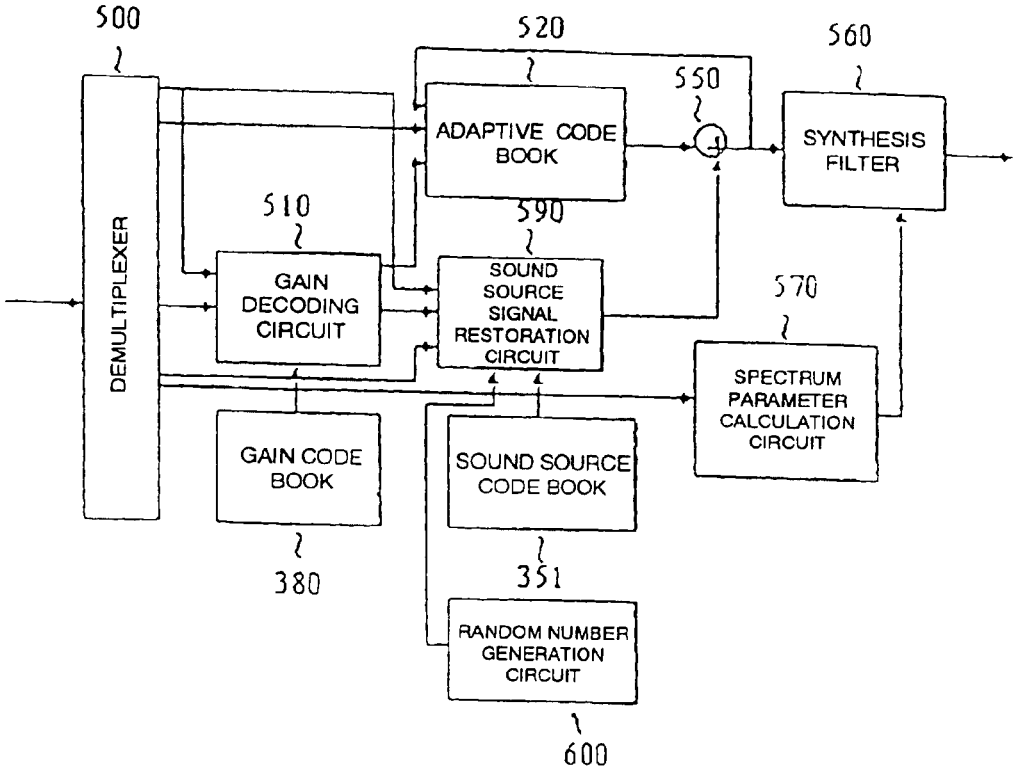
FIG. 22 is a block diagram of another decoding apparatus according to the present invention.

FIG. 22 is a block diagram of another decoding apparatus according to the present invention. This decoding apparatus may be combined to the coding apparatus shown in FIG. 2 to form a coding/decoding apparatus. Since constituent elements in FIG. 22 to which the same reference numerals as in FIG. 21 perform the same operations as in FIG. 21 are added perform the same operations as in FIG. 21, a description thereof will be omitted.

In FIG. 22, when mode decision information is Modes 1 to 3, a sound source signal restoration circuit 590 generates a sound source signal by using a polarity code vector read from a sound source code book 351, positional information of pulses, and a gain code vector to output the sound source signal to the adder 550. When the mode decision information is mode 0, the positions of pulses are generated from the random number generation circuit 600, and a sound source signal is generated by using the gain code vector to output the sound source signal to the adder 550.

INDUSTRIAL APPLICABILITY

According to the present invention described above, in a predetermined mode, the number of pulses can be considerably increased in comparison with a conventional method. For this reason, even though voice on which background noise is superposed is coded at a low bit rate, a background noise component can be preferably coded and decoded.

What is claimed is:

1. A voice coding apparatus comprising:

a spectrum quantization circuit for calculating and quantizing a spectrum parameter of a voice signal;

an adaptive code book circuit for predicting said voice signal from a sound source signal to calculate a residual;

a sound source quantization circuit for quantizing said sound source signal by using said spectrum parameter to output the quantized sound source signal;

a gain quantization circuit for quantizing a gain of said sound source signal;

a mode decision circuit for extracting characteristics from said voice signal to decide a mode; and a multiplexer unit for multiplexing an output from said spectrum parameter quantization circuit, an output from said mode decision circuit, an output from said adaptive code book circuit, an output from said sound source quantization circuit, and an output from said gain quantization circuit to output the multiplexed result, characterized in that:

when the output from said mode decision circuit represents a predetermined mode, said sound source signal is represented by a combination of a plurality of pulses wherein an amplitude or polarity of the pulse is calculated from said voice signal; and said sound source quantization unit selects a shift amount and a code vector, which minimize distortion between an input signal and a reproduced signal, from combinations of a plurality of shift amounts by which the pulses shift and gain code vectors.

2. The voice coding apparatus according to claim 1, characterized in that the positions of the pulses the number of which is predetermined are arranged at predetermined intervals, and a plurality of shift amounts for shifting the positions of the pulses as a whole are determined.

3. The voice coding apparatus according to claim 1, characterized in that the combinations of the positions of the pulses the number of which is predetermined are generated at random, and the plurality of combinations are determined.

4. A voice decoding apparatus characterized by comprising:

a demultiplexer unit which receives information related to a spectrum parameter, information related to a decision signal, information related to an adaptive code book, and information related to a sound source signal to separate the pieces of information from each other;

a sound source signal generation unit adapted to generate a sound source signal from an adaptive code vector, a shift amount of a pulse position, and a gain code vector when the decision signal represents a predetermined mode; and a synthesis filter unit which receives the sound source signal constituted by a spectrum parameter to output a reproduced signal.

5. A voice decoding apparatus characterized by comprising:

a demultiplexer unit which receives information related to a spectrum parameter, information related to a decision signal, information related to an adaptive code book, and information related to a sound source signal to separate the pieces of information from each other;

a sound source signal generation unit adapted to generate positions of pulses representing sound source signals at random and generating a sound source signal by using an adaptive code vector and a gain code vector when the decision signal represents a specific mode; and a synthesis filter unit which receives the sound source signal constituted by a spectrum parameter to output a reproduced signal.

* * * * *